TELFER CARRIAGE

BACKGROUND OF INVENTION

The present invention concerns a telfer carriage such as for a hoist comprising dual end supports a supporting beam, hoisting and displacing machinery and a rope drum.

The drawback of telfer carriages of prior art was in many instances their carriage large size compared with the load which they lift. In particular the large height dimension has been objectionable because it has often been necessary on account of this height to raise the roof of a shop hall higher. Moreover, extra loads have been imposed by the big and heavy telfer carriage structures both on the building and on the hoist itself. It becomes necessary to reinforce the buildings, and similarly the beam structures of the hoisting means must be made sturdy. This tends to involve undesirably high costs.

SUMMARY OF INVENTION

The object of the present invention is to provide a telfer carriage which is small in size, and light weight related to the load which it can lift. Particularly great attention has been paid to the height dimension of the telfer carriage. The telfer carriage of the invention comprises dual end supports, a supporting beam, hoisting and displacing machinery and a rope drum. The telfer carriage is characterized in that the dual end supports have been pivotally affixed to the supporting beam, and that the end supports have been rigidly joined to each other by means of a non-rotating axle, on which furthermore the rope drum and a pair of carrying wheels have been rotatably carried. The advantage of such a telfer carriage is its small size and, as a consequence thereof, its light weight. When the supporting beam undergoes deflection by effect of the load, the pivots prevent the bending moment from being transferred to the end supports, which therefore need not handle any stresses arising from tilting of the end supports.

The telfer carriage according to a favourable embodiment of the invention is characterized in that the supporting beam is located immediately beside the rope drum and parallels it. The advantage is a compact carriage construction.

The telfer carriage of another favourable embodiment is characterized in that the axis of the pivot between the supporting beam and the end supports is parallel with the end support's longitudinal axis.

The telfer carriage of still another favourable embodiment is characterized in that the top margin of the supporting beam and the highest point of the rope drum are on the same height, and that the lower margin of the web plate between the rope drum and the rope sheaves lies above the axial plane of the rope drum. The advantage is then a low structural height for the carriage and the avoidance of dangerous S bights in the lifting ropes.

DESCRIPTION OF INVENTION

Figure 1:
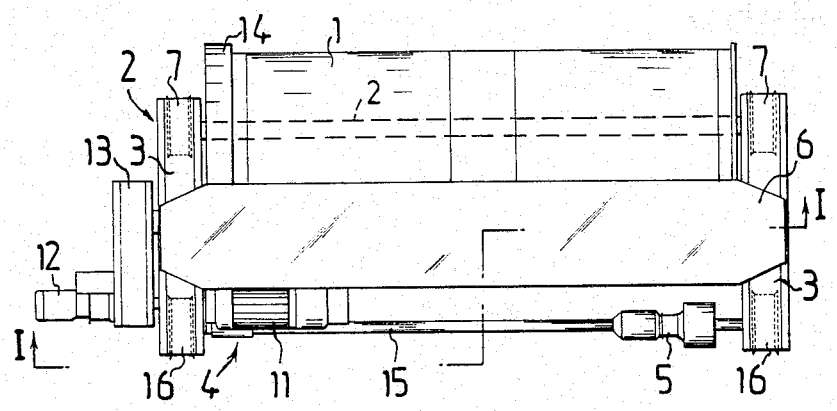
Figure 2:
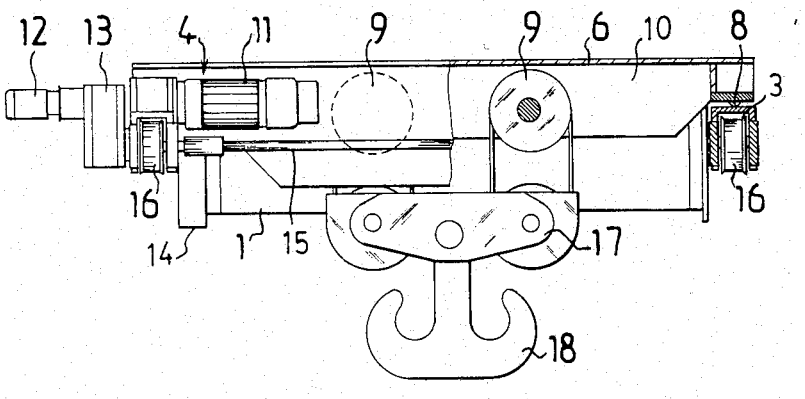
Figure 3:
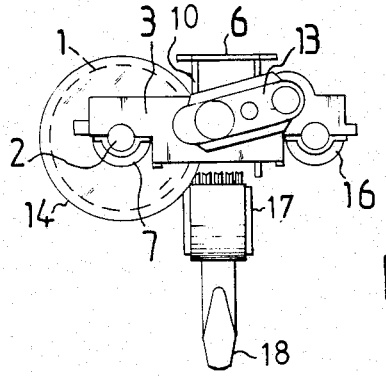

The invention is described in greater detail in the following with the aid of an example, with reference being made to the attached drawings, wherein:

FIG. 1 presents the telfer carriage of the invention, in top view;

FIG. 2 shows the telfer carriage as viewed from the front and sectioned along the line I—I in FIG. 1; and FIG. 3 shows the telfer carriage in elevational end view.

As shown in the drawings, the telfer carriage comprises a rope drum 1 which is rotatably carried on a stationary axle 2. On the same axle 2, the carrying wheel pair 7 has also been rotatably mounted. The carrying wheels are located within the end supports 3. Moreover, the end supports 3 have been rigidly joined by the same non-rotating axle 2, which takes up the steering forces of the telfer carriage. The supporting beam 6 is a welded sheet metal structure open on the underside, and it has been affixed with pivots 8 to the end supports 3 so that the supporting beam 6 will be immediately adjacent to the rope drum 1 and parallel therewith. The pivots 8 parallel the end supports 3 and have been fixed on top of them. This pivotal attachment makes possible the action that the bending stresses arising in the supporting beam 6 are not transmitted to the end supports 3.

Inside the supporting beam 6 has been rotatably carried the set of rope sheaves 9 which transmits the rope forces to the supporting beam. The hoisting mechanism comprises, among other things, a hoisting motor 11 with brake, a fine adjustment mechanism 12, a lifting gearbox 13 and an open transmission 14. Furthermore, the telfer carriage comprises a displacement mechanism 5 and displacement shaft 15 with carrying wheels 16. The hook housing 17 and hook 18 have been designed with a very minimal height, with a view to economizing the important space. It is also an important feature of the invention that web plate 10 of the supporting beam 6, which is towards the rope drum 1, has been designed such that its lower margin lies higher than the axial horizontal plane of the rope drum 1. This is important in order that one might avoid S bights which are dangerous to the ropes, as the ropes run from the drum to the hook. The top margin of the supporting beam 6 and the highest point of the rope drum 1 are on the same height.

It is obvious to a person skilled in the art that different embodiments of the invention are not exclusively confined to the example related above and that they may vary within the scope of the claims below.

I claim:

1. A telfer carriage having light weight and low structural height, comprising:

dual end supports for the carriage, said end supports being mutually rigidly joined together by a non-rotating axle; a carrying wheel pair located within said end supports and rotatably mounted on opposite ends of said axle;

a supporting beam having said dual end supports pivotally affixed to the supporting beam by dual pivots, said supporting beam including a web plate and having a set of rope sheaves rotatably carried therein; and hoisting and carriage displacing mechanisms and a rope drum which is rotatably carried on said axle, whereby the dual pivots provided between the dual end supports and the supporting beam prevent bending loads imposed on the supporting beam from being transmitted to the end supports and thereby provides light weight and low structural weight for the carriage.

2. A telfer carriage according to claim 1, wherein the supporting beam lies immediately beside the rope drum and is parallel therewith.

3. A telfer carriage according to claim 1, wherein the top margin of the supporting beam and the highest point of the rope drum are on the same height and that the

United States Patent [19]

Swartzbaugh et al.

[11] Patent Number: 4,503,985

[45] Date of Patent: Mar. 12, 1985

[54] TAMPER INDICATING PACKAGE WITH LARGE DIAMETER OPENING

[75] Inventors: Peter T. Swartzbaugh, Toledo; Edward M. Hehl, Perrysburg, both of Ohio

[73] Assignee: Owens-Illinois, Inc., Toledo, Ohio

[21] Appl. No.: 543,700

[22] Filed: Oct. 20, 1983

[51] Int. Cl.[3] ..... B65D 41/34

[52] U.S. Cl. ..... 215/252

[58] Field of Search ..... 215/252, 258

[56] References Cited

U.S. PATENT DOCUMENTS

| | | | |
|---|---|---|---|
| 3,329,295 | 7/1967 | Fields | 215/252 |
| 3,901,403 | 8/1975 | Menke | 215/258 X |
| 4,299,328 | 11/1981 | Ochs et al. | 215/252 |
| 4,322,012 | 3/1982 | Conti | 215/252 X |
| 4,333,577 | 6/1982 | Mumford | 215/252 X |
| 4,436,212 | 3/1984 | Llera | 215/258 X |

*Primary Examiner*—Donald F. Norton

*Attorney, Agent, or Firm*—John R. Nelson; Myron E. Click

[57] ABSTRACT

A tamper indicating package comprising a container having a neck finish with a large opening and threads on the exterior thereof, and an annular bead spaced axially from the threads and away from the open end of the container and a plastic closure having a top wall and a peripheral skirt formed with interrupted threads adapted to engage the threads on the container and an integral tamper indicating band on the periphery of the skirt connected thereto by an internal groove which defines a weakened line and having an interrupted radially extending bead adapted to engage the bead on the container. The bead on the tamper indicating band is interrupted along the same axial plane as the threads on the skirt so that the tamper indicating band is without a bead in substantially the same areas as the portions of the skirt are without threads.

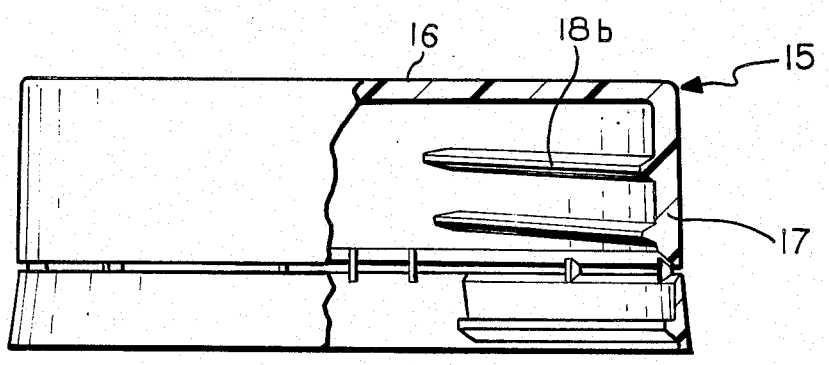

10 Claims, 4 Drawing Figures